US007866648B2

(12) United States Patent
Noh

(10) Patent No.: US 7,866,648 B2
(45) Date of Patent: Jan. 11, 2011

(54) MULTIPLE STAPLING APPARATUS

(75) Inventor: Seung-Kyoon Noh, Seoul (KR)

(73) Assignees: KRDC Co., Ltd, Seoul (KR); Gradco (Japan) Ltd., Tokyo (JP)

( * ) Notice: Subject to any disclaimer, the term of this patent is extended or adjusted under 35 U.S.C. 154(b) by 607 days.

(21) Appl. No.: 11/662,367

(22) PCT Filed: Sep. 9, 2004

(86) PCT No.: PCT/KR2004/002292

§ 371 (c)(1),
(2), (4) Date: Mar. 14, 2008

(87) PCT Pub. No.: WO2006/028307

PCT Pub. Date: Mar. 16, 2006

(65) Prior Publication Data

US 2008/0185767 A1 Aug. 7, 2008

(51) Int. Cl.
*B65H 37/04* (2006.01)

(52) U.S. Cl. ..... 270/58.12; 270/58.07; 270/58.08; 270/58.11; 270/58.17

(58) Field of Classification Search ..... 270/58.07, 270/58.08, 58.11, 58.12, 58.17, 58.27
See application file for complete search history.

(56) References Cited

U.S. PATENT DOCUMENTS 6,145,825 A * 11/2000 Kunihiro et al. ..... 270/58.09
6,296,247 B1 * 10/2001 Tamura et al. ..... 271/214
6,343,785 B1 * 2/2002 Yamada et al. ..... 270/58.08
6,527,269 B2 * 3/2003 Yamada et al. ..... 271/221
2007/0096381 A1 * 5/2007 Nishioka ..... 270/58.12

FOREIGN PATENT DOCUMENTS

JP 9-086779 A 3/1997
JP 9-240913 A 9/1997
JP 12-335815 A 12/2000
JP 2000-335815 A 12/2000

* cited by examiner

*Primary Examiner*—Leslie A Nicholson, III
(74) *Attorney, Agent, or Firm*—Birch, Stewart, Kolasch & Birch, LLP

(57) ABSTRACT

Disclosed is a multiple stapling apparatus that can staple at least two or more parts of a sheet by exactly supporting the sheet a stapling position of a sheet finisher which finishes the sheet ejected from a digital output device. The multiple stapling apparatus includes a clamp shaft (65) parallel to a moving direction of the stapler, a first guide (50) having a first base wall (51) axially rotated around the clamp shaft (65) at a predetermined angle on the clamp shaft, supporting the sheet stacked on the compile tray, and second guides (60*a* and 60*b*) having second base walls (61*a* and 61*b*) slid along the clamp shaft along with the stapler, supporting the sheet on the compile tray when the first base wall is opened, wherein the first guide is axially rotated at a predetermined angle around the clamp shaft to open the first base wall when the stapler moves at a predetermined distance along the clamp shaft from a hole position (94). In case that the sheet is supported by the first base wall, the edge of the sheet can be stapled by rotation of the stapler. In case that the sheet is supported by the second base wall, two or more parts of the sheet can be stapled while the stapler is moved along the supported sheet.

9 Claims, 11 Drawing Sheets

MULTIPLE STAPLING APPARATUS

TECHNICAL FIELD

The present invention relates to a multiple stapling apparatus that staples and finishes sheets ejected from an image forming apparatus such as a printer and a copier, and more particularly to a multiple stapling apparatus having a compile tray that supports sheets to enable multiple stapling on a base surface of the sheets.

BACKGROUND ART

A general image forming apparatus having a stapler will be described with reference to FIG. 1.

As shown in FIG. 1, the image forming apparatus such as a digital output device 1 includes a sheet finisher 2 that finishes sheets ejected from the image forming apparatus. The sheet finisher 2 is located at a side of the image forming apparatus, and includes an image tray module 15, a finisher module 20, and a sheet feeding module 40.

The image tray module 15 stacks sheets copied through the digital output unit 1 onto an image tray 22. The finisher module 20 punches the finished sheets using a punch 25 and staples the sheets using a stapling apparatus 24 so as to stack the sheets onto a stack tray 27. The sheet feeding module 40 distributes the sheets to the image tray module 15 and the finisher module 20.

In the aforementioned image forming apparatus, the stapling apparatus 24 includes a stapler fixed at a certain position and a compile tray feeding sheets to the stapler and aligning the sheets. However, multiple stapling of the sheet cannot be achieved by the structure that the stapler is fixed at a certain position.

DETAILED DESCRIPTION OF THE INVENTION

Technical Problem

Accordingly, the present invention is directed to a multiple stapling apparatus that substantially obviates one or more of the problems due to limitations and disadvantages of the related art.

An object of the present invention is to provide a multiple stapling apparatus that adjusts the position of sheets to enable multiple stapling with one stapler and provides a means which supports the sheets.

Technical Solution

To achieve these and other advantages and in accordance with the purpose of the present invention, as embodied and broadly described, a multiple stapling apparatus according to the present invention includes a clamp shaft 65 formed on a stapler 75 in parallel to a moving direction of the stapler, a first guide 50 axially rotated around the clamp shaft 65 at a predetermined angle on the clamp shaft, and a pair of second guides 60*a* and 60*b* respectively formed at both sides of the stapler and slid along the clamp shaft.

The first guide includes a first base wall 51 and a projection 53. The first base wall 51 supports a sheet 80 stacked on a compile tray 70 when the end of the sheet is stapled in an inclined direction and also supports the sheet when the sheet is ejected after being aligned without any stapling.

The projection 53 of the first guide is designed in such a manner that the sheet stacked on the compile tray directly adjoins a second base wall 61 of the second guide as the first base wall is opened when the projection adjoins the upper surface of the stapler and is lifted.

The second base wall is provided at both sides of the second guides to support the sheet at the stapling position and moves along with the stapler so that the sheet can be stapled regardless of the moving position of the stapler.

The stapler moves in parallel to the central shaft of the clamp shaft and is rotated at a predetermined angle around the direction perpendicular to the central shaft of the clamp shaft between the second guides.

The sheet can be stapled in an inclined direction in a state that the stapler is rotated at a predetermined angle.

ADVANTAGEOUS EFFECTS

The multiple stapling apparatus according to the present invention has the following advantages.

The multiple stapling apparatus includes a clamp shaft 65 parallel to a moving direction of a stapler 75, a first guide 50 having a first base wall 51 axially rotated around the clamp shaft 65 at a predetermined angle on the clamp shaft, supporting a sheet stacked on a compile tray 70, and a pair of second guides 60*a* and 60*b* having second base walls 61*a* and 61*b* slid along the clamp shaft along with the stapler, supporting the sheet on the compile tray when the first base wall is opened, wherein the first guide includes a projection 53 axially rotated at a predetermined angle around the clamp shaft to open the first base wall when the stapler moves at a predetermined distance along the clamp shaft from a hole position 94. By this structure, the sheet supported by the first guide or the second guide can be stapled. Particularly, the second guide exactly supports the sheet 80 at the stapling position to enable multiple stapling even if the stapler 75 moves.

BEST MODE

Figure 1:
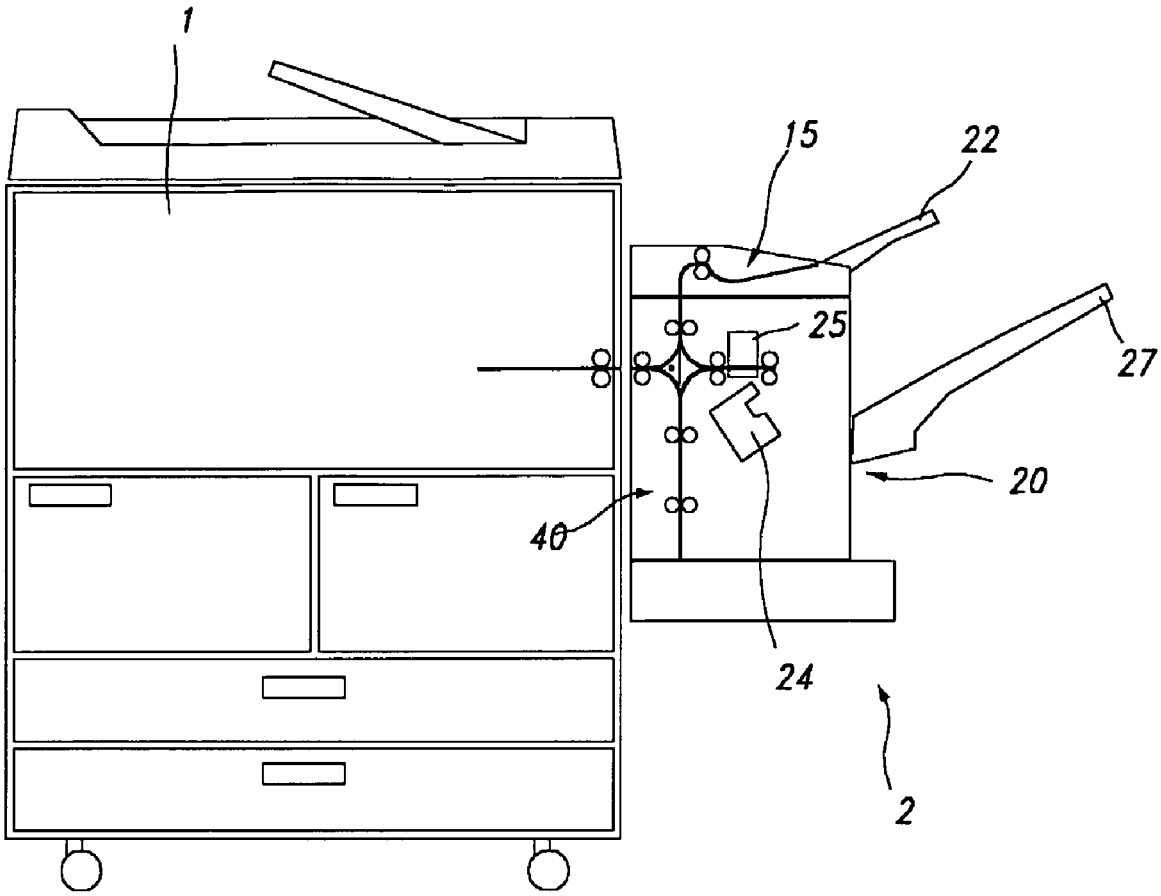
FIG. 1 illustrates a finisher module of a general image forming apparatus.

In a multiple stapling apparatus having a compile tray 70 and a stapler 75 stapling at least two or more parts of a sheet along the section of a sheet 80 stacked on the compile tray, the multiple stapling apparatus includes a clamp shaft 65 parallel to a moving direction of the stapler, a first guide 50 having a first base wall 51 axially rotated around the clamp shaft 65 at a predetermined angle on the clamp shaft, supporting the sheet stacked on the compile tray, and second guides 60*a* and 60*b* having second base walls 61*a* and 61*b* slid along the clamp shaft along with the stapler, supporting the sheet on the compile tray when the first base wall is opened, wherein the first guide is axially rotated at a predetermined angle around the clamp shaft to open the first base wall when the stapler moves at a predetermined distance along the clamp shaft from a hole position 94.

The sheet is stapled when it is supported by the first base wall or the second base walls.

The first guide further includes a projection 53 that axially rotates the first guide when it adjoins the stapler 75.

The projection is slid along an upper surface of the stapler 75.

The second guides are respectively provided at both sides of the stapler 75 and are moved along the moving direction of the stapler along with the stapler.

The second guides are elastically supported by a spring 63, one of the second guides being locked in the first guide 50 when the stapler moves at a predetermined distance along the clamp shaft.

The second guides are elastically supported by a spring 63, one of the second guides being pushed by a the stapler to move along with the stapler when the stapler moves at a predetermined distance along the clamp shaft.

The stapler is rotated at a predetermined angle between the second guides around a direction perpendicular to a central shaft of the clamp shaft.

Reference will now be made in detail to the preferred embodiments of the present invention, examples of which are illustrated in the accompanying drawings.

A multiple stapling apparatus according to the present invention will be described with reference to FIG. 2 to FIG. 12.

The multiple stapling apparatus of the present invention includes a stapler 75 having a clamp shaft 65 which is arranged on the stapler 75 in parallel to a moving direction of the stapler 75. The clamp shaft is provided with a first guide 50 and a pair of second guides 60*a* and 60*b*. The first guide includes a first base wall 51, and a projection 53, and clamps 52*a*, 52*b* and 52*c* arranged at a certain interval in a single body. The second guides 60*a* and 60*b* includes second base walls 61*a* and 61*b* and clamps 62*a* and 62*b* in a single body.

The clamps 52*a*, 52*b* and 52*c* of the first guide 50 clamp the first guide to be axially rotated at a predetermined angle on the clamp shaft 65 but not to be moved in a direction of the clamp shaft. Meanwhile, the clamp 62*a* of the second guide 60*a* and the clamp 62*b* of the second guide 60*b* are respectively clamped to be slid on the clamp shaft 65 but not to be rotated.

The second guide 60*a* is provided at the left of the clamp 52*a* of the first guide and the second guide 60*b* is provided at the right of the clamp 52*b* of the first guide. The second guides 60*a* and 60*b* are elastically supported by a spring 63.

The stapler 75 is provided between the second guides 60*a* and 60*b*. When the stapler 75 approaches to the first guide 50, the projection 53 of the first guide is slid on the stapler to lift the first guide so that the first base wall 51 is opened.

The second base walls 61*a* and 61*b* of the second guides arranged at both sides of the stapler 75 support the end of the sheet fed onto the compile tray 70 to enable multiple stapling of the sheet.

The stapler 75 is arranged on a stapler rotary plate 81 provided on a stapler moving plate 76. The stapler moving plate 76 is provided on a frame 77 arranged in parallel to the clamp shaft 65. A stapler moving guide 78 is provided on the frame 77 and the stapler moving plate 76 is inserted into the stapler moving guide to move the stapler moving plate toward the clamp shaft 65.

Figure 2:
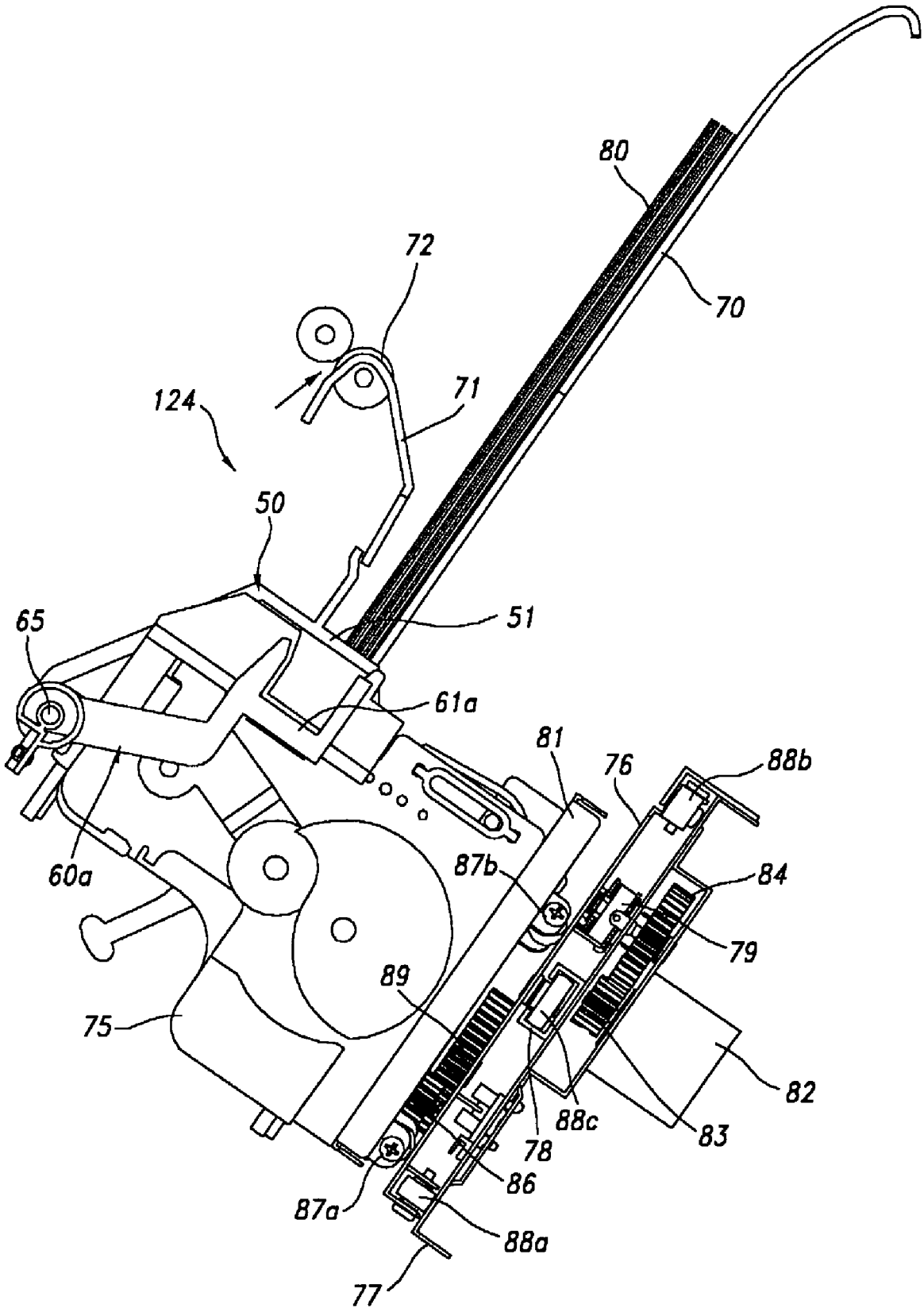
FIG. 2 is a side view illustrating a multiple stapling apparatus according to the present invention.
Figure 3:
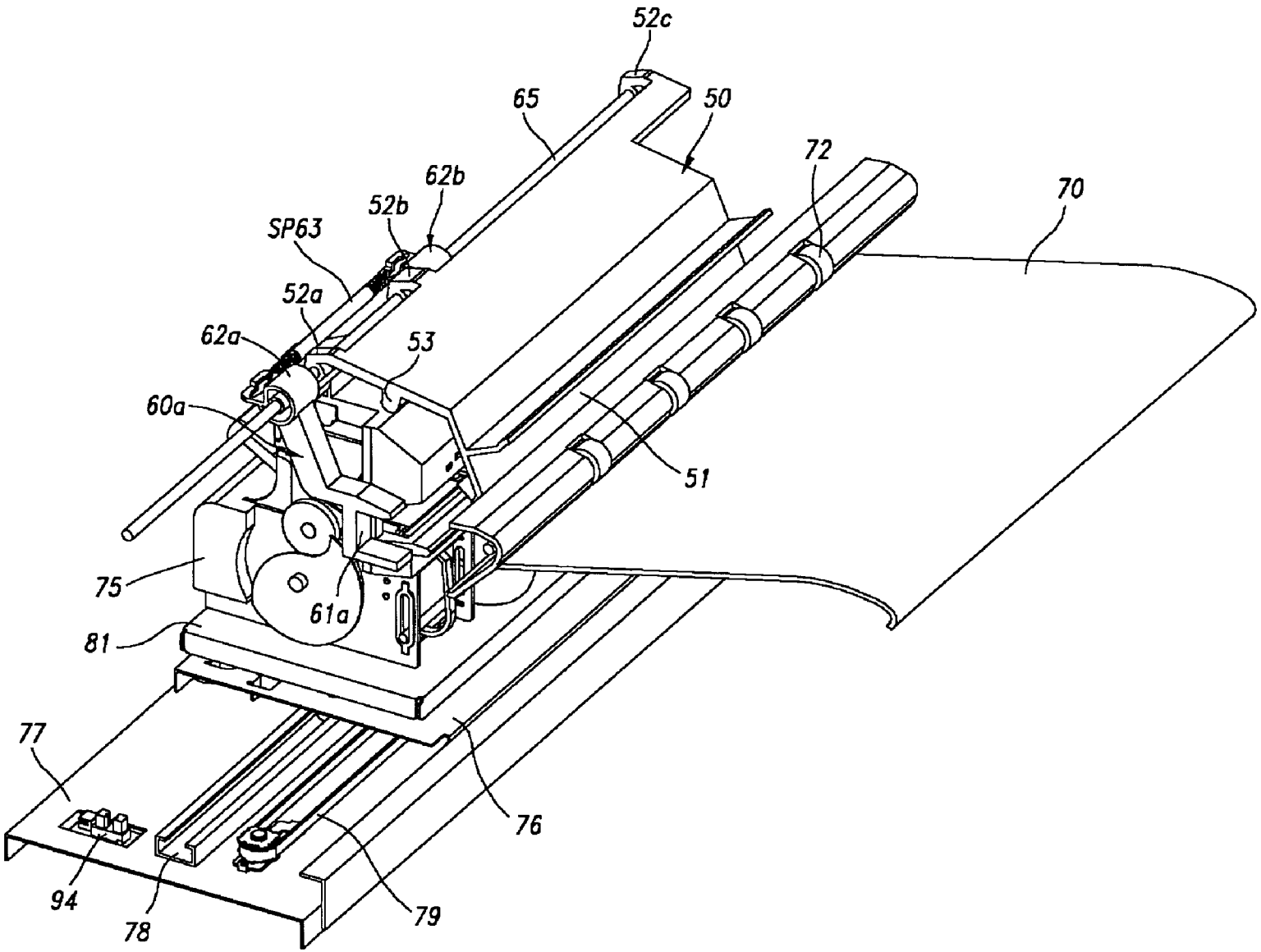
FIG. 3 is an elevational view illustrating a multiple stapling apparatus according to the present invention.
Figure 4:
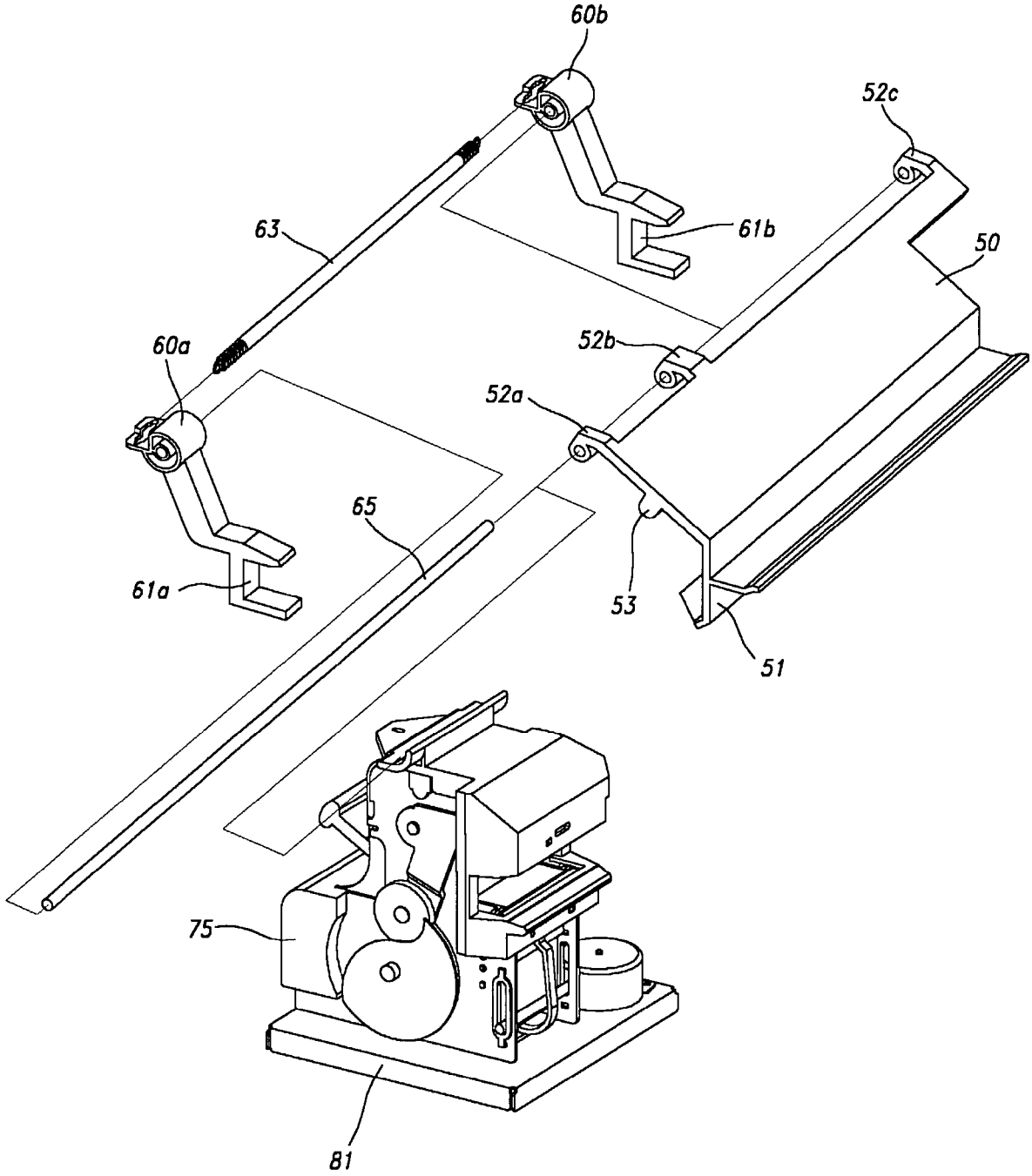
FIG. 4 is an exploded perspective view illustrating a multiple stapling apparatus according to the present invention.
Figure 10:
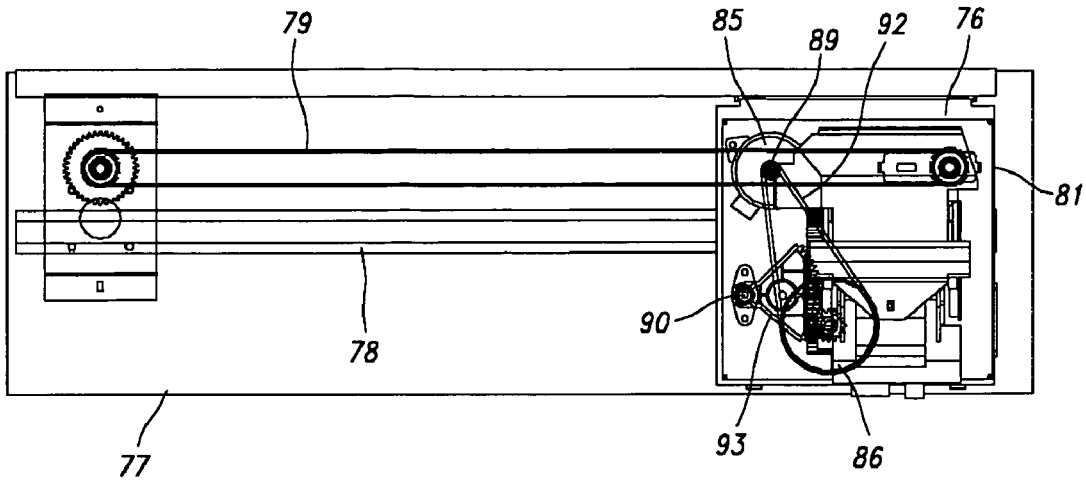
FIGS. 10 and 11 illustrate the rotational operation of a multiple stapling apparatus according to the present invention.
Figure 11:
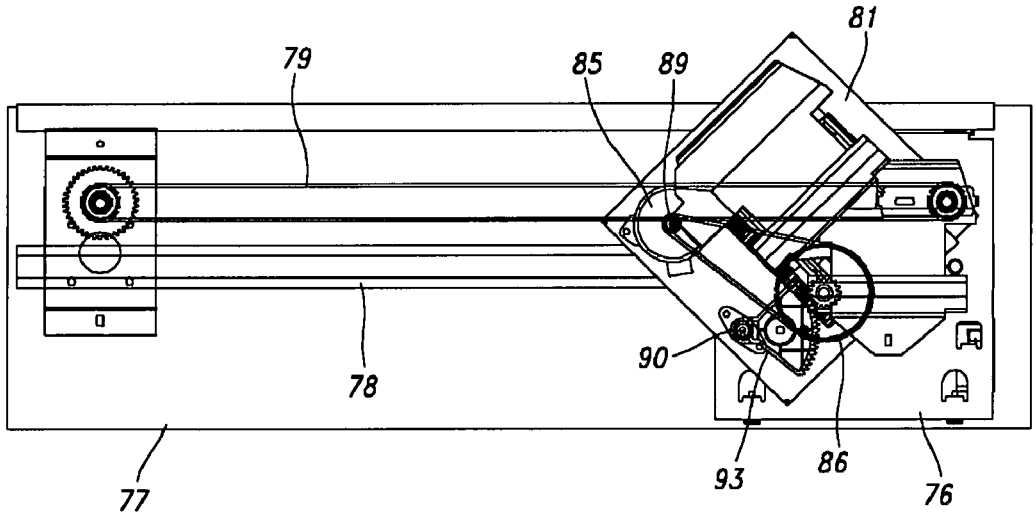

The stapler moving plate 76, as shown in FIGS. 2, 10 and 11, is moved by a stapler moving belt 79 provided along the direction of the stapler moving guide 78.

The stapler moving belt 79 is driven by a stapler moving motor 82 provided at the lower portion of the frame 77. A stapler moving gear 83 fixed to the shaft of the stapler moving motor and a stapler moving gear pulley 84 engaged with the stapler moving gear are provided between the stapler moving motor 82 and the stapler moving belt 79.

Further, stapler moving plate rollers 88*a*, 88*b* and 88*c* are provided at the lower portion of the stapler moving plate 76 to reduce friction when the stapler moving plate moves.

Particularly, the roller 88*c* inserted into the stapler moving guide 78 serves to clamp the stapler moving plate 76 when the stapler moving plate 76 moves along the stapler moving guide 78.

Meanwhile, the stapler rotary plate 81 provided on the stapler moving plate 76 is rotated at a predetermined angle in a direction perpendicular to the clamp shaft 65.

To rotate the stapler rotary plate 81 on the stapler moving plate 76, the stapler rotary plate includes a stapler rotational motor 85, a stapler rotational gear pulley 89 and a stapler rotational gear 86. The stapler rotational gear pulley and the stapler rotational gear are linked with each other by the stapler rotational belt 92.

The stapler rotational gear 89 is engaged with a stapler rotational shaft gear 93 fixed to a stapler rotational central shaft 90. The stapler rotational central shaft 90 links the stapler moving plate 76 to the stapler rotary plate 81.

Rotational rollers 87*a* and 87*b* are provided at the lower portion of the stapler rotary plate 81 to prevent friction from being generated when the stapler rotary plate is rotated.

Therefore, once the stapler rotational motor 85 is driven, the stapler rotary plate 81 is rotated at a predetermined angle along with the stapler 75 around the stapler rotational central shaft 90.

The operation of the aforementioned multiple stapling apparatus 124 according to the present invention will be described in more detail.

Figure 12:
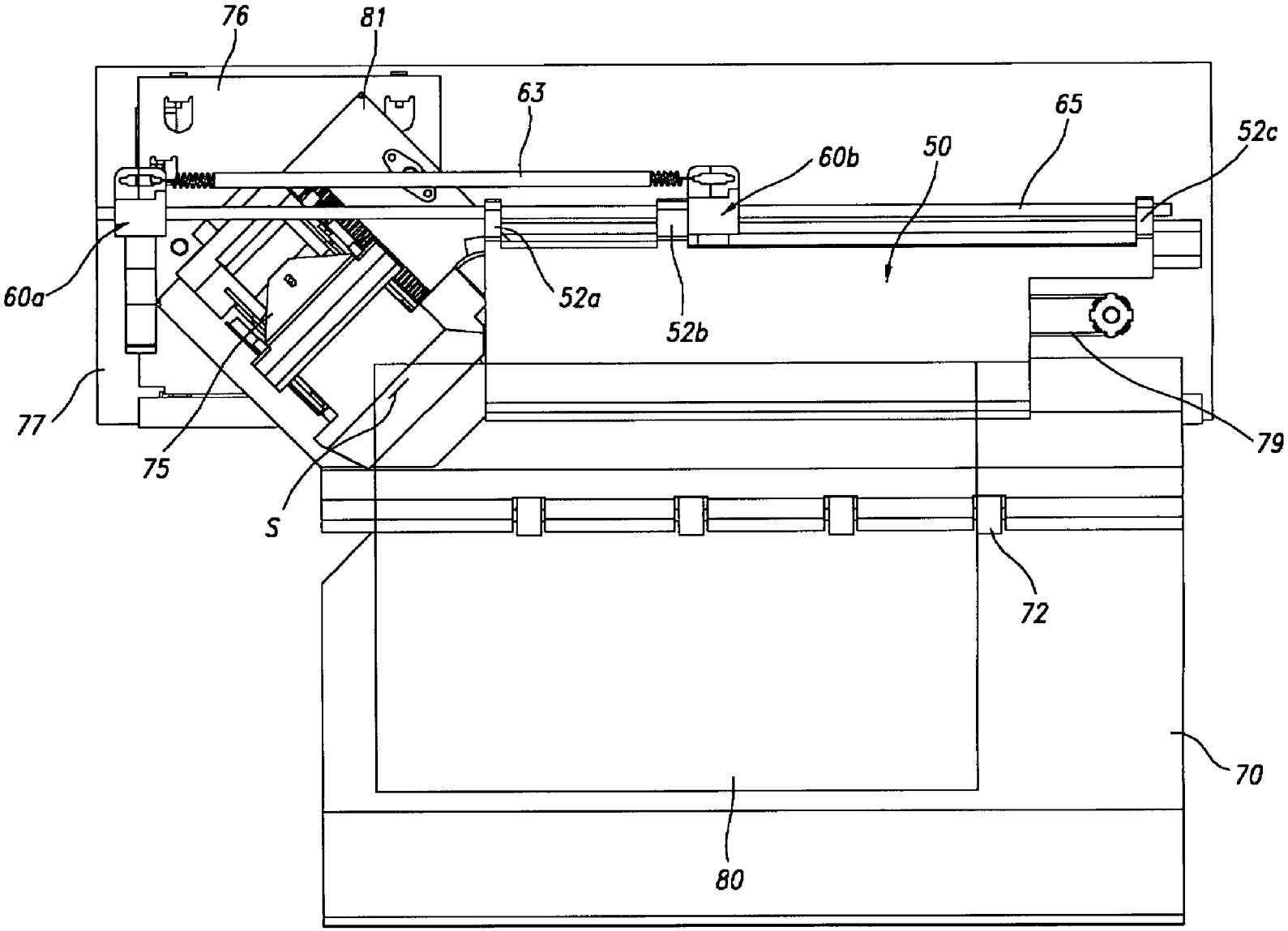
FIG. 12 illustrates a structure that a stapler staples a bundle of sheets in a state that it is rotatably driven in accordance with a multiple stapling apparatus of the present invention.

The sheet 80 is fed through a feeding roller 72 in a direction of an arrow shown in FIG. 2 and is stacked on the compile tray 70. The end of the sheet stacked on the compile tray is supported by the first base wall 51 of the first guide 50. In this state, the sheet is only aligned without being stapled and is directly ejected to an outer stacker (not shown). Alternatively, the edge of the sheet is stapled by rotation of the stapler and then is ejected to the stacker as shown in FIG. 12.

Figure 5:
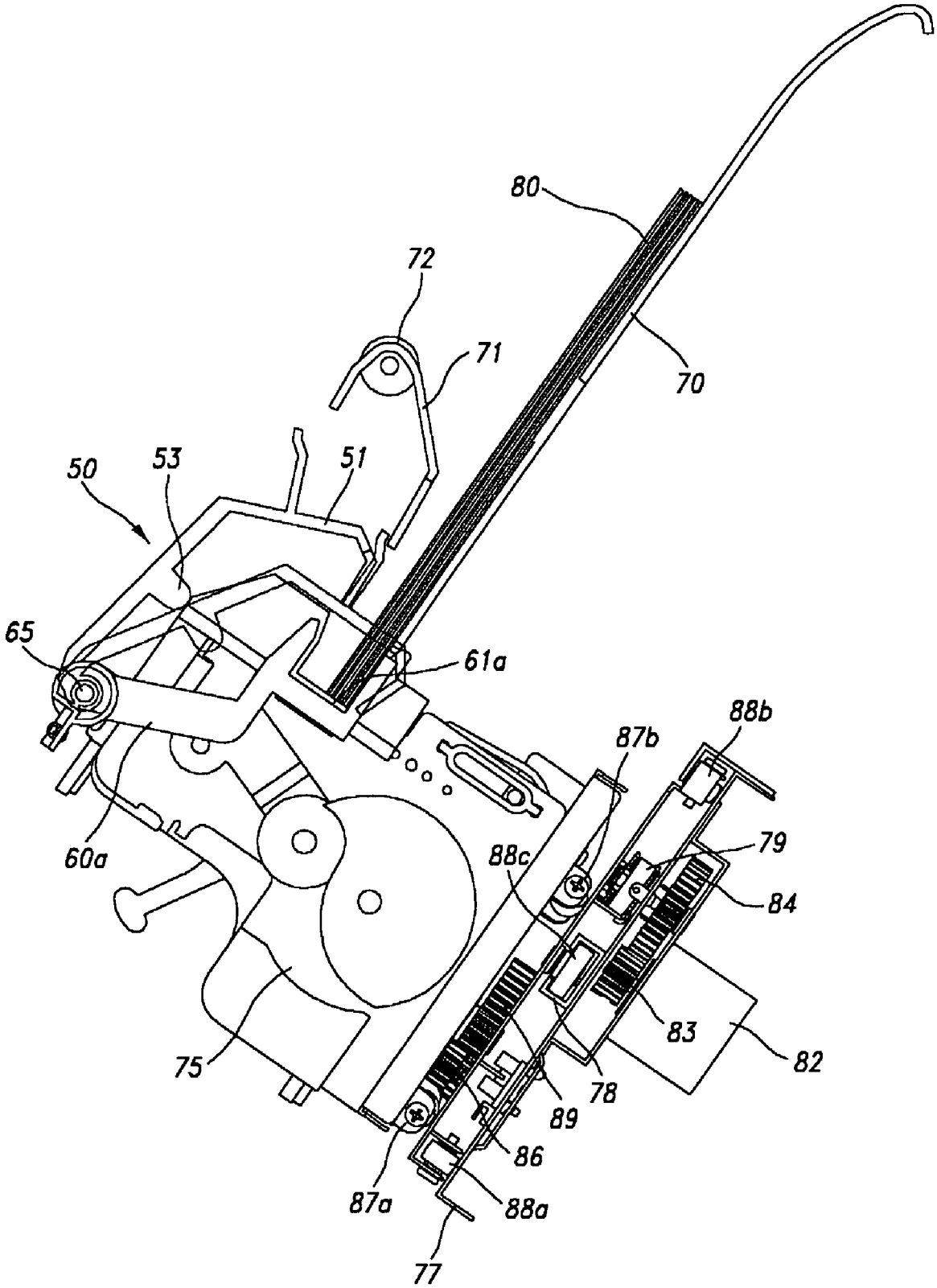
FIG. 5 illustrates the state that a bundle of sheets are fed to the multiple stapling position of a multiple stapling apparatus according to the present invention.

Meanwhile, once the stapler moves to the first guide 50 to enable multiple stapling of the sheet stacked on the compile tray 70, the projection 53 of the first guide 50 adjoins the upper surface of the stapler 75 as shown in FIG. 5 so that the first guide 50 is lifted around the clamp shaft 65. As a result, the first base wall 51 is opened. Once the first base wall 51 is opened, for exact stapling the sheet 80 aligned on the compile tray 70 is supported by the second base walls 61*a* and 61*b* of the second guides 60*a* and 60*b* positioned at both sides of the stapler.

Figure 6:
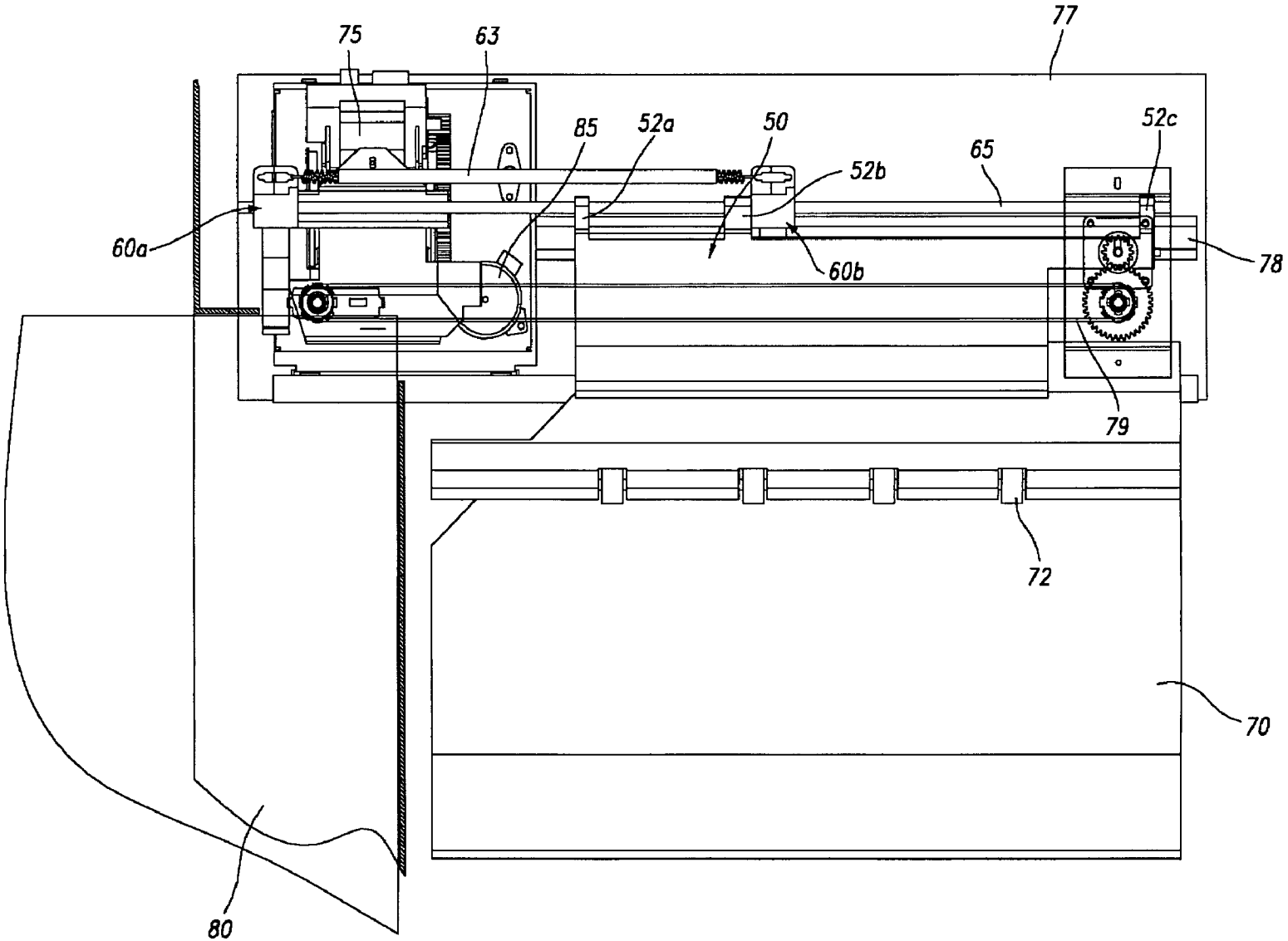
FIGS. 6 to 9 illustrate the stapling operation of a multiple stapling apparatus according to the present invention.
Figure 9:
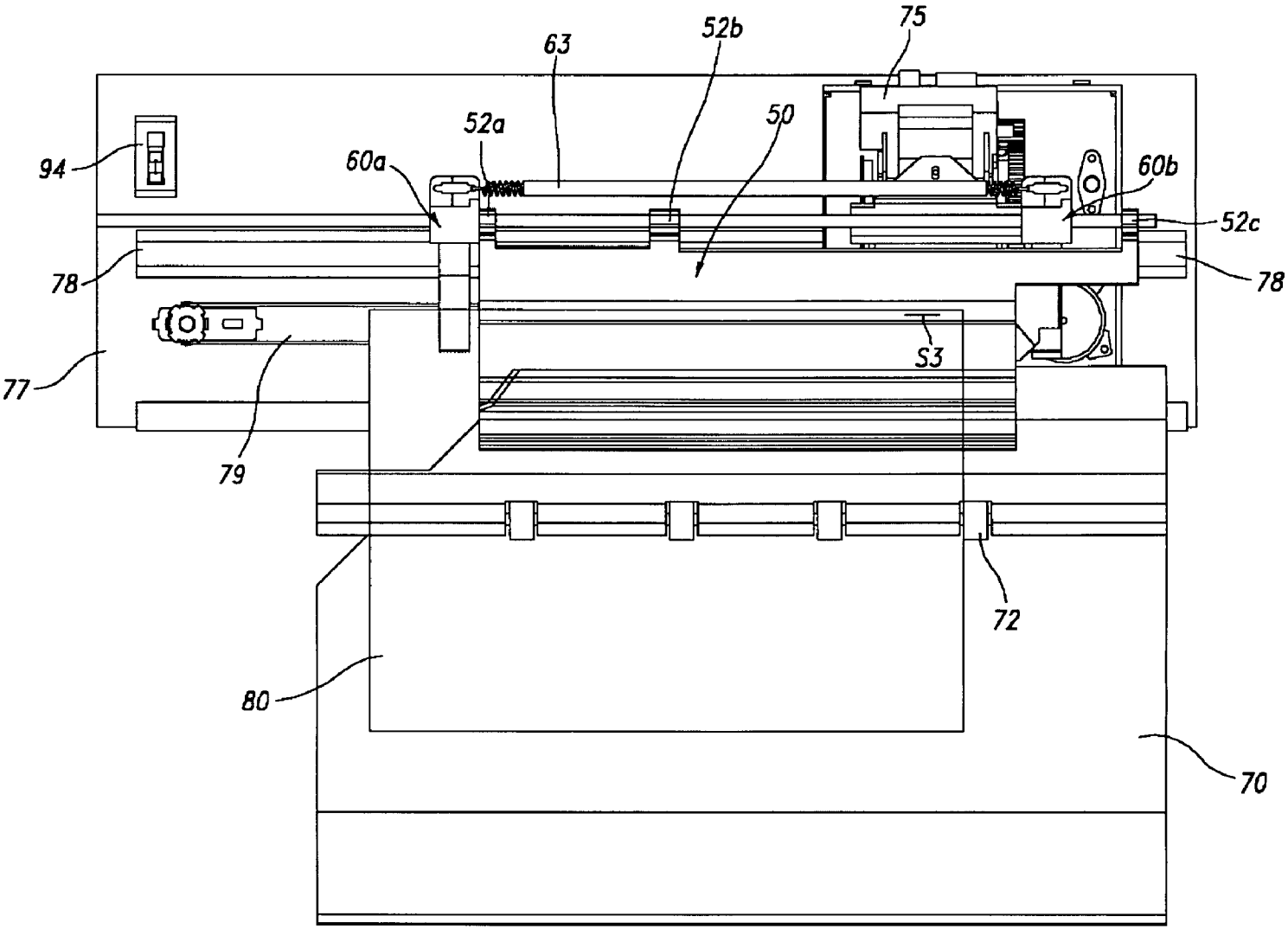

Referring to FIG. 6 and FIG. 9, the sheet 80 is stapled in accordance with the position of the stapler 75. FIG. 6 illustrates a structure that the sheet 80 is manually stapled at a hole position 94 of the stapler 75. In this structure, the second guide 60*a* is locked one side of the stapler 75 and the second guide 60*b* is locked in the clamp 52*b* of the first guide 50. Thus, the second guides are spaced apart from the stapler.

Figure 7:
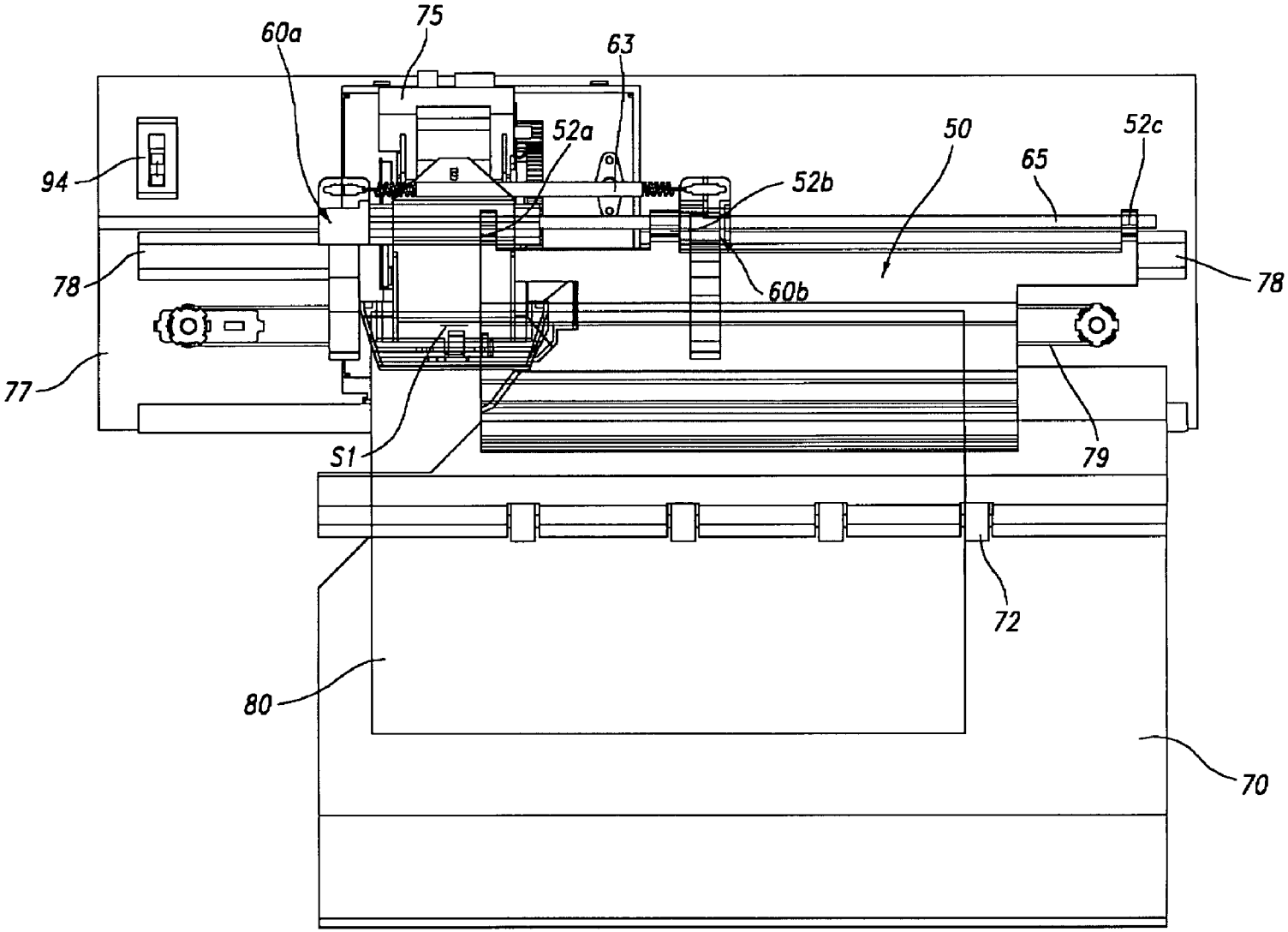

Referring to FIG. 7, the moving position of the stapler is shown when the outer edge of the sheet fed onto the compile tray 70 is stapled. The projection of the first guide is lifted by the upper portion of the stapler so that the first base wall 51 of the first guide is opened. In this state, the edge of the sheet 80 is automatically stapled (S1), and the stapler 75 is moved to the position of FIG. 8 to staple the central end of the sheet 80 (S2).

Figure 8:
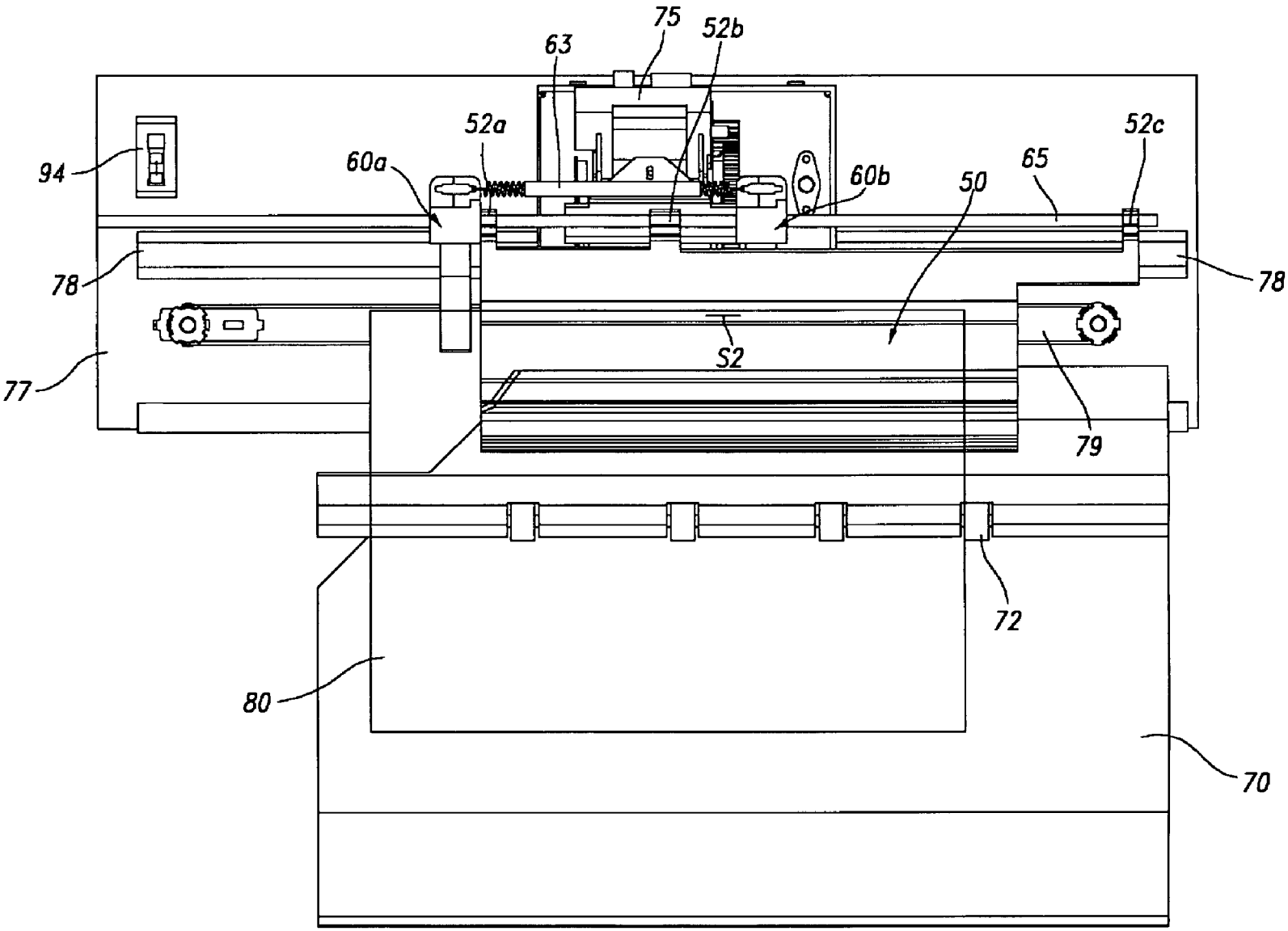

In the structure of FIG. 8, the second guide 60*a* is locked in the clamp 52*a* of the first guide. In this case, the second guide 60*a* is not moved any longer along with the stapler 75. The second guide 60*b* is pushed by the stapler 75 and is moved along with the stapler 75.

The distance between the second guides 60*a* and 60*b* that support the sheet at the stapling position is properly controlled in accordance with the moving position of the stapler 75. In this case, the sheet 80 is exactly supported wherever the stapler is positioned.

Referring to FIG. 9, the end of the sheet 80 is stapled (S3) in a state that the stapler moves toward the farthest position from the hole position 94.

FIGS. 10 and 11 illustrate the rotational operation of the stapler 75.

Referring to FIG. 10, the stapler 75 staples the sheet in parallel with the end of the sheet. In the state of FIG. 10, once the stapler rotational motor 85 provided on the stapler rotary plate 81 is driven, the stapler rotational gear 86 is rotated through the stapler rotational belt 92. Thus, the stapler rotary plate 81 is rotated by action of the stapler rotational central shaft 90 and the stapler rotary shaft gear 93 as shown in FIG. 11.

FIG. 12 illustrates a structure that the stapler staples the edge of the sheet 80 in a state that the stapler rotary plate, that is, the stapler 75 is rotated. Referring to FIG. 12, the stapler staples the edge of the sheet in an inclined direction. That is, the edge of the sheet is stapled in an inclined direction in a state that the sheet 80 is supported by the first base wall 51 of the first guide. One of the edges of the sheet can be stapled in a state that the stapler is rotated. In case that the middle portion of the sheet is stapled, the stapler returns to the original position and the first base wall is opened.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A multiple stapling apparatus comprising:

a compile tray configured to hold a plurality of stacked sheets;

a stapler configured to staple at least two or more parts of a sheet of the plurality of stacked sheets by moving in a moving direction along a section of the plurality of stacked sheets;

a clamp shaft arranged parallel to the moving direction of the stapler;

a first guide rotatable about the clamp shaft, the first guide having a first base wall to support the plurality of stacked sheets, the first guide being configured to rotate about the clamp shaft to move the first base wall away from the plurality of stacked sheets when the stapler moves a predetermined distance along the clamp shaft from a first position; and a pair of second guides configured to be slidable along the clamp shaft with the stapler, each of the second guides having a second base wall configured to support the plurality of stacked sheets when the first base wall is moved away from the plurality of stacked sheets.

2. The multiple stapling apparatus according to claim 1, wherein the stapler is configured to staple the sheet when the sheet is supported by the first base wall or the second base walls.

3. The multiple stapling apparatus according to claim 1, wherein the first guide further includes a projection that rotates the first guide when the projection contacts the stapler.

4. The multiple stapling apparatus according to claim 3, wherein the projection is configured to slide along an upper surface of the stapler.

5. The multiple stapling apparatus according to claim 1, wherein the second guides are provided at opposites sides of the stapler and are moveable along the moving direction of the stapler.

6. The multiple stapling apparatus according to claim 5, wherein the second guides are elastically supported by a spring, one of the second guides contacting the first guide when the stapler moves at a predetermined distance along the clamp shaft.

7. The multiple stapling apparatus according to claim 5, wherein the second guides are elastically supported by a spring, one of the second guides being pushed by the stapler to move with the stapler along when the stapler moves a predetermined distance along the clamp shaft.

8. The multiple stapling apparatus according to claim 5, wherein the stapler is configured to be rotatable a predetermined angle between the second guides around a direction perpendicular to a central shaft of the clamp shaft.

9. The multiple stapling apparatus according to claim 1, wherein, when the stapler is positioned in the first position, the stapler is configured to staple an edge of the sheet supported by the first base wall of the first guide.

* * * * *